US011386817B2

(12) United States Patent
Zoll

(10) Patent No.: US 11,386,817 B2
(45) Date of Patent: Jul. 12, 2022

(54) ADVERTISING SYSTEM

(71) Applicant: Madeleine Zoll, Sigmaringen (DE)

(72) Inventor: Madeleine Zoll, Sigmaringen (DE)

( * ) Notice: Subject to any disclaimer, the term of this patent is extended or adjusted under 35 U.S.C. 154(b) by 0 days.

(21) Appl. No.: 17/202,894

(22) Filed: Mar. 16, 2021

(65) Prior Publication Data

US 2021/0225210 A1 Jul. 22, 2021

Related U.S. Application Data

(63) Continuation of application No. PCT/EP2019/073409, filed on Sep. 3, 2019.

(30) Foreign Application Priority Data

Sep. 17, 2018 (DE) ..... 10 2018 122 685.3

(51) Int. Cl.
*G09F 3/20* (2006.01)
*G09F 9/30* (2006.01)
*G09F 9/33* (2006.01)

(52) U.S. Cl.
CPC ..... *G09F 9/301* (2013.01); *G09F 9/335* (2021.05)

(58) Field of Classification Search
CPC ..... G09F 9/30; G09F 9/301; G09F 9/3026; G09F 9/33; G09F 9/335; G09F 9/35; G09F 15/0018; G09F 15/0031; G09F 15/0037; G09F 15/005; G09F 15/0075; G09F 27/00
See application file for complete search history.

(56) References Cited

U.S. PATENT DOCUMENTS 2,272,622 A * 2/1942 Rundle ..... G09F 19/18 353/76
3,022,417 A * 2/1962 Linderoth ..... F21V 1/06 362/358
3,713,237 A 1/1973 Thomson et al.
5,422,737 A * 6/1995 Atoji ..... H04N 1/08 355/75
6,269,570 B1 8/2001 Miles
2004/0033461 A1* 2/2004 Hart ..... A47J 37/074 431/126

(Continued)

FOREIGN PATENT DOCUMENTS

CN 1950865 A 4/2007
CN 103985325 A 8/2014

(Continued)

OTHER PUBLICATIONS

German Office Action (Application No. 10 2018 122 685.3) dated May 10, 2019 (with English translation).

(Continued)

*Primary Examiner* — Joe H Cheng
(74) *Attorney, Agent, or Firm* — Burr & Brown, PLLC

(57) ABSTRACT

The invention relates to an advertising system, comprising an advertising medium with a support, and at least one film, characterized in that the support has at least one holder for holding a flat film. The film can be introduced into the holder and can be replaced, and the holder has multiple holding elements which alone or together with the support form one or more grooves that are suited and designed to hold the film in the formed groove and guide same so as to form a cylindrical or semicylindrical structure.

12 Claims, 5 Drawing Sheets

(56) References Cited

U.S. PATENT DOCUMENTS

| | | | | |
|---|---|---|---|---|
| 2006/0032099 | A1* | 2/2006 | Lyall, III | G09F 23/08 40/650 |
| 2012/0081905 | A1 | 4/2012 | Santiago | |
| 2015/0338051 | A1* | 11/2015 | Thomas | F21V 1/143 362/359 |
| 2017/0027361 | A1 | 2/2017 | Santiago | |
| 2019/0213931 | A1* | 7/2019 | Brubaker | G06Q 30/0266 |

FOREIGN PATENT DOCUMENTS

| | | | |
|---|---|---|---|
| CN | 107680508 | A | 2/2018 |
| DE | 10 2007 004 597 | A1 | 10/2008 |
| DE | 10 2016 120 317 | A1 | 4/2018 |
| GB | 1 318 655 | A | 5/1973 |
| GB | 2 541 372 | A | 2/2017 |

OTHER PUBLICATIONS

German Office Action (Application No. 10 2018 122 685.3) dated Jul. 16, 2019 (with English translation).
International Search Report and Written Opinion (Application No. PCT/EP2019/073409) dated Nov. 27, 2019.
Chinese Office Action (Application No. 201980060732.0) dated Feb. 16. 2022 (with English translation).

* cited by examiner

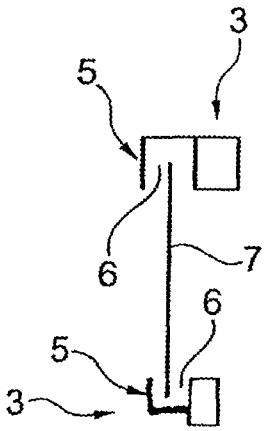
Fig. 4.1
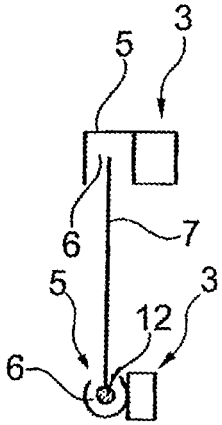
Fig. 4.2
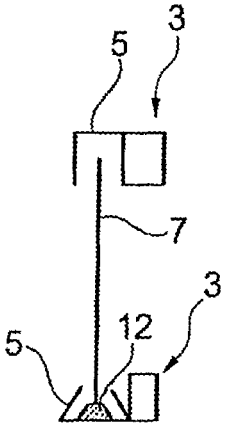
Fig. 4.3
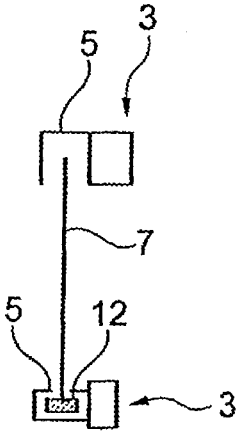
Fig. 4.4
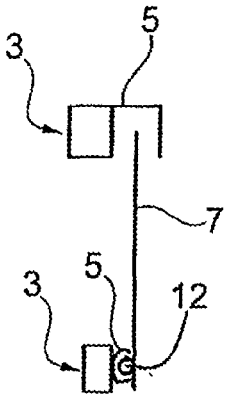
Fig. 4.5
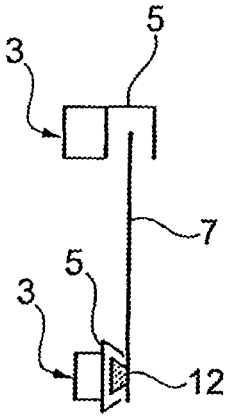
Fig. 4.6
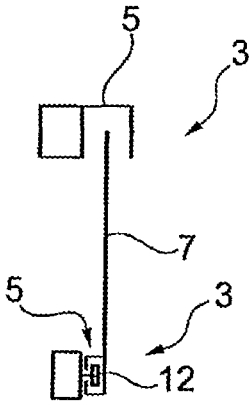
Fig. 4.7
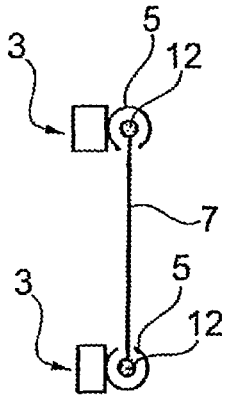
Fig. 4.8
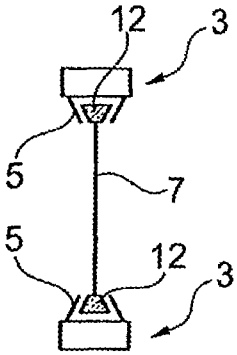
Fig. 4.9
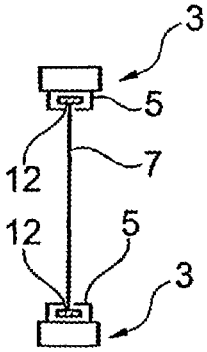
Fig. 4.10

ADVERTISING SYSTEM

CROSS REFERENCE TO RELATED APPLICATIONS

This application is a continuation of International Application No. PCT/EP2019/073409 filed Sep. 3, 2019, which designated the United States, and claims the benefit under 35 USC § 119(a)-(d) of German Application No. 10 2018 122 685.3 filed Sep. 17, 2018, the entireties of which are incorporated herein by reference.

FIELD OF THE INVENTION

The present invention relates to an advertising system which is suitable for disseminating information, in particular, advertisements.

BACKGROUND OF THE INVENTION

An advertising column which provides a display for variable display is known from DE 10 2016 120 317 A1, for example.

SUMMARY OF THE INVENTION

The present invention is based on the object of achieving an advertising system which is improved in comparison to the prior art and by way of which items of information or advertisements can be rendered so as to be visible in a particularly conspicuous manner, and which is able to be rapidly replaced and handled in a cost-effective manner.

The advertising system according to the present invention comprises a support structure for an advertising space and has at least one planar film. The film herein can also be configured as an only partially closed ring. The support herein has at least one receptacle for receiving the planar film. The film herein is configured such that the film is able to be incorporated into the receptacle and replaced. A simple and rapid changeover of the film is possible on account thereof. The handling herein proves to be particularly simple; the complexity is associated with minor costs.

It has proven particularly successful to configure the advertising system according to the present invention such that the receptacle of the advertising system has one or a plurality of receptacle elements which individually or conjointly with the support form one or a plurality of grooves which are suitable and provided for receiving and guiding the film in the formed groove. The groove in terms of the cross-section herein is enclosed in a U-shaped manner. The groove can be formed by a profiled element which encloses the groove in a U-shaped manner, and which fulfils the function of a receptacle element and, in particular, also that of the support. The receptacle elements as separate components can be separated from the remainder of the support or be manufactured as separate components and thereafter be connected to the remainder of the support. It is, however, also conceivable for the receptacle elements and the support to be integrally configured, or be unified so as to form one component, respectively.

An easy incorporation of the film and, thus, a simple replacement of the film is, thus, guaranteed in a simple, reliable, and rapid manner.

The film can in principle be guided in a groove, in particular, at two mutually opposite sides or peripheries, respectively, of the film. In order to improve the guiding properties and to be able to, in particular, more easily handle the film during guiding, elements which are, in particular, guided on the film and which are incorporated into a receptacle element, in particular, into the groove, can be provided. Guided elements can, thus, be guided in the receptacle element or in the groove, respectively, wherein in the context of the present invention the guided element is moved in relation to the receptacle element or the groove, respectively, or the receptacle element or the groove, respectively, is moved in relation to the guided element. Since the film is typically pushed in, the latter is most often moved in relation to the support or the receptacle element, respectively, that is to say that whether the guided element is moved in relation to the receptacle element/the groove or vice versa in most instances depends on whether the film has a guided element or a groove. In principle, the film can be provided with reinforcements on the peripheries. Alternatively, guided elements can also be made available in the form of profiled parts which are fastened to the periphery of the film.

Moreover, profiled parts or guided elements, respectively, of this type can also be configured so as to be coded in that the profiled parts or guided elements, respectively, in terms of cross-sectional shape are identical to the corresponding groove or the receptacle element, respectively, for example. This herein can be a round or oval cross-section, for example, or else a polygon. Depending on the embodiment, only specific films which are correspondingly coded can be used henceforth. On account of this measure, the risk of an unsuitable film being able to be rapidly released from and drop out of the mounting is minimized, for example. A material property, for example a flame-retardant property, can be guaranteed by way of the coding.

Conversely, the support too can have a guided element, while the film provides a receptacle element, in particular, in the form of a groove, such that the receptacle element of the film is pushed over the guided element of the support. In this case, the guided element is static, and the receptacle element is moved when the film is being pushed in.

In one preferred refinement of the present invention, the support as well as the film can in each case have receptacle elements and guided elements. The possibility of coding is implemented in a particularly effective manner in this way because it is indeed difficult for an unsuitable film, for example, an easily flammable film which is not coded in this manner, to be put in place.

Moreover, a groove or a receptacle element, respectively, in the context of the present invention can in principle be configured in a U-shaped manner. The periphery may however also partially project on the open side of such a receptacle and partially delimit the opening. The groove, or the receptacle element, respectively, in terms of the cross-section can, however, also have radii, edges which do not run so as to be mutually orthogonal, or other shaped features.

Furthermore, receptacle elements or guided elements, respectively, can be attached so as to be above, below, lateral to or otherwise offset to, the support.

It has proven particularly successful for receptacle elements to be disposed on the upper and the lower periphery of the support and be suitable and provided for receiving and guiding the upper and the lower periphery of the film. A receptacle element herein, individually or while interacting with the support, can have a U-shaped cross-section and entirely or partially receive the lower or the upper periphery of the film according to the present invention and guide the film.

Alternatively, a plurality of receptacle elements can also be provided for conjointly receiving and guiding the upper or the lower periphery. By providing these receptacle elements it is possible to guide and hold the film so as to form a closed or an open ring such that the advertising system, using the film as a display, is formed in a simple and reliable manner. On account of this configuration of the present invention, it is guaranteed to a particular degree that the film is correctly and reliably received, or replaced, such that damage to the film can be largely avoided.

In one preferred refinement of the advertising system according to the present invention, the receptacle elements or guided elements, respectively, are configured by at least one ring, in particular, an upper and a lower ring. Reliable and uniform guiding even of rigid or particularly soft films is provided herein, this potentially highly simplifying the changeover of the films and increasing the durability of the films. This is achieved, in particular, when one annular receptacle element is in each case provided for the upper and the lower periphery of the film, respectively.

As an alternative to an annular or partially annular receptacle element it has also proven successful for a plurality of individual, mutually spaced apart, receptacle elements or guided elements, respectively, to be disposed on an annular or partially annular track and on account thereof to form a receptacle or a guide, respectively, for a periphery of the film according to the present invention of the advertising system. A very appealing receptacle is formed on account of this arrangement. The receptacle likewise enables the film to be replaced in a simple and reliable manner. More than six receptacle elements or guided elements are preferably disposed on an annular track which is preferably configured so as to be circular or elliptic.

It has, moreover, proven advantageous for the plurality of receptacle elements of the two formed rings to be disposed so as to be mutually offset along the circumference of the support. It is achieved on account thereof that a U-shaped receptacle element is disposed in an alternating manner on the upper periphery and on the lower periphery along the circumference of the film disposed in an annular manner. It is achieved on account thereof that the number of the U-shaped receptacle elements along the upper or the lower periphery of the film disposed in an annular manner is reduced, and on account thereof the construction of the advertising system according to the present invention is simplified without the handling being made significantly complicated.

It has proven particularly useful herein for the receptacle having preferably a plurality of receptacle elements along the circumference of the support of the advertising system according to the present invention to be provided with an introduction opening for incorporating the film into the annular receptacle. The incorporation of the film by way of the introduction opening, and correspondingly also the changeover of the film, is enabled in a rapid and reliable manner on account thereof. This applies in particular when the length of the film is selected so as to be smaller than or equal to the circumference of the annular receptacle.

This is particularly the case when the introduction opening is provided according to the present invention with an introduction region which adjoins the annular receptacle so as to be approximately tangential thereto and which is suitable and provided for guiding the film such that the film can be incorporated into or retrieved from the annular receptacle. This is guaranteed, in particular, when the introduction region tapers off in a conical manner in the direction of the introduction opening and, thus, in the direction of the receptacle. The incorporation of the film and, thus, also the changeover of the film is, in particular, guaranteed in a simple, rapid and reliable manner on account thereof.

The support, the receptacle or the receptacle elements, respectively, can be integrally made from a profile, or be fixedly connected to one another, respectively. These parts can thus form, in particular, a stable self-supporting structure, that is to say that the film per se does not, or not substantially, contribute toward stability. This facilitates, in particular, the assembly and the changeover of the film, because a stable or self-supporting structure, respectively, is already present when the film is being incorporated and the support does not have to be stabilized.

A particularly preferred configuration of the present invention shows one or a plurality of receptacle elements which are provided with anti-friction means. Not all receptacle elements herein have to be provided with anti-friction mechanisms. These anti-friction mechanisms reduce the friction of the film in the receptacle element or the receptacle elements of the advertising system according to the present invention such that an easy incorporation of the films into the receptacle element or the receptacle elements is guaranteed, and damage to the films can largely be prevented. One or a plurality of anti-friction means herein can be configured, in particular, from Teflon, as an anti-friction roller and/or an anti-friction face having a reduced coefficient of friction.

According to one particularly preferred configuration of the advertising system according to the present invention, the support has a rotationally symmetrical shape, in particular, a cylindrical shape, a frustoconical shape, a hollow-cylindrical shape, or a hollow-frustoconical shape. These shapes can be produced in a particularly simple and, thus, cost-effective manner. Also, the films for incorporating into the receptacles of the advertising system can be produced in a simple and, thus, cost-effective manner, because very simple film areas result by virtue of this shaping. Moreover, the incorporation of the film into the receptacles is possible in a simple and reliable manner because the films do not have to be creased, and damage to the films or rapid wear can largely be avoided on account thereof. Apart from the rotationally symmetrical shapes, shapes which are not rotationally symmetrical are also possible.

A further advantage of this configuration according to the present invention of the advertising system is demonstrated in that items of information, or graphics, in particular, logos or trademarks, that are depicted on the film, and thus the film of the advertising system, can be readily seen from different spatial directions on account of the rotationally symmetrical shape of the support of the advertising system. On account thereof, it is possible for the items of information to be made simultaneously accessible to many viewers in a simple manner, and for the items of information to be adapted or varied by replacing the films when required.

In one particularly advantageous configuration, the film is to be formed while using elastically resilient plastics material. Alternatively or additionally, it has also proven successful for the film to be configured using a translucent paper and/or woven fabric or a translucent composite material. A simple replacement of the film and, thus, a wide variation of items of information depicted on the film is possible on account of these flexible materials, on the one hand.

According to one preferred refinement of the present invention, the film has a material thickness of a few tenths of a millimeter, in particular, of approximately 0.2 mm, such that sufficient flexibility of the film is provided for incorporating the film in a simple and easy manner into the receptacle of the advertising system while providing sufficient transparency. These films prove to be simple and cost-effective in terms of production.

It has moreover proven to be particularly successful for the films for the advertising system according to the present invention to be configured while using, in particular, polycarbonate (PC), polyethylene (PE), polyester, polyvinyl chloride (PVC), and/or polyether (PA). These materials can also be configured so as to be translucent.

Digital films such as OLED and QLED films can advantageously also be used for projecting a film or as variable advertising spaces. For example, items of information such as notices, advertisements and/or advertising texts, company logos and/or similar can be applied and thus be presented to the public in a simple and inclusive manner.

It has proven particularly advantageous herein for the film to be configured so as to be at least partially reinforced in the peripheral region. That region of the periphery that engages in the groove of the receptacle elements is preferably configured so as to be reinforced herein. An improved handling capability and, in particular, a greater durability is achieved on account thereof, this additionally proving to reduce costs.

It has moreover proven successful for the film in the peripheral region to be configured such that the film has a low coefficient of friction, in particular, a coefficient of friction which is reduced in relation to the remainder of the film, on account of which the incorporating, the receiving and the guiding of the film in the receptacle element or receptacle elements can take place in a particularly easy manner. Particularly positive handling when incorporating or retrieving the film, and thus when replacing the film, is guaranteed on account thereof. Particularly easy sliding in the groove of the receptacle is achieved on account of the low coefficient of friction.

In one particularly preferred variant of the present invention, an introduction opening or an introduction region, respectively, into which the film can be pushed and on the opposite side of the introduction region or the introduction opening, respectively, be retrieved again (or vice versa) is provided. This enables the film to be changed in a particularly rapid and simple manner. The pushing in of the film can then be performed in a tangential manner, for example, or in a substantially tangential manner.

BRIEF DESCRIPTION OF THE DRAWINGS

The present invention will be explained in an exemplary manner hereunder by means of a preferred exemplary embodiment with reference to the illustrations. The present invention is not limited to this preferred exemplary embodiment.

FIGS. 4.1 to 4.10 show various combinations of receptacle elements and guided elements in a support and a film according to the present invention.

DETAILED DESCRIPTION OF THE INVENTION

Figure 1:
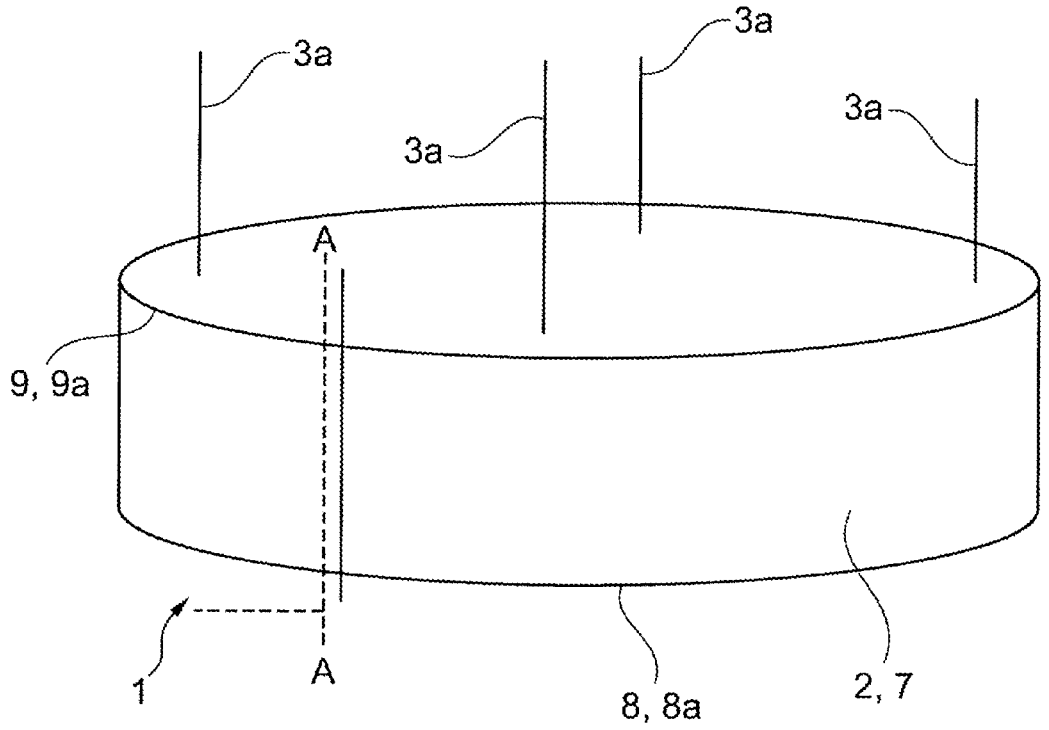
FIG. 1 in a schematic illustration shows an exemplary advertising system according to the present invention.

An advertising system 1 such as can be used in shopping centers, exhibition halls, supermarkets, department stores and shops of any sector is schematically illustrated in FIG. 1.

The advertising system 1 shows a support 3 and an advertising space 2 which is composed of a film 7 disposed in an annular manner.

The support 3 contains a receptacle 4 for receiving the planar film 7. This receptacle 4 shows a plurality of receptacle elements 5 which conjointly with the support 3 form a groove 6 which is enclosed in a U-shaped manner. The film 7 as an advertising space 2 is received in the formed groove 6 and guided such that the film 7 is closed so as to form a ring.

The film 7 herein, in the shape of a strip is formed in the manner of a rectangle from 0.2 mm thick elastic plastics material and encloses the support 3 in an annular manner in that the two narrow ends of the strip-shaped film 7 abut one another and form a ring which is not closed.

The film 7 herein at the upper periphery 9 and on the lower periphery 8, respectively, is received and guided by two annular receptacle elements 5, an upper ring 9*a* and a lower ring 8*a*.

The advertising space 2 having the support 3 has a cylindrical shape.

The film 7 herein is preferably structured in color such that items of information, in particular, in the form of advertising texts, logos and/or trademarks are applied or incorporated, respectively, and these items of information are relayed to the observer on account thereof. This advertising system 1 according to the present invention has an informative function.

The advertising system 1 is fastened to the ceiling of the room by way of four support cables 3*a*.

Figure 2:
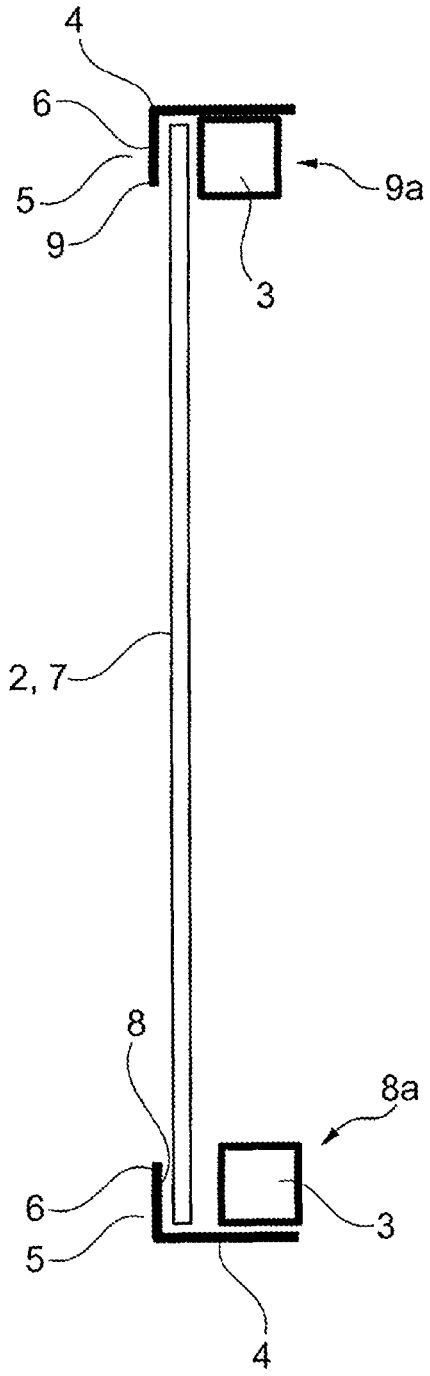
FIG. 2 shows a schematic view of the advertising system along the section line A-A from FIG. 1.

The construction of the support 3 having the receptacle 4 and the advertising space 2 as is shown along the section line A-A from FIG. 1 is schematically illustrated in FIG. 2.

The film 7 of the advertising space 2 shows a lower periphery 8 and an upper periphery 9 which are guided and held in the grooves 6. The grooves 6 are formed by the support 3, which is square in cross-section, and by the receptacle 4 which is connected to the support 3, or by the receptacle element 5, respectively, in that the components 3, 4, 5 enclose the groove in a U-shaped manner.

The support 3 and the receptacle 4, or the receptacle element 5, respectively, are formed from painted metal or plastics material and form in each case one upper ring 9*a* and one lower ring 8*a*, respectively, as is illustrated in FIG. 1. The film 7 as an advertising space is received and guided in an annular manner between these two rings 8*a*, 9*a*, in the respective annular groove 6.

The elastic, planar film 7 when being incorporated into the grooves 6 follows the curvature of the latter until the film 7 is guided so as to form an almost closed ring and thus forms the advertising space 2 of the advertising system 1 according to the present invention.

The receptacle 4 for the film 7 here is formed by two annular receptacle elements 5, an upper ring 9*a* and a lower ring 8*a*. These receptacle elements 5, conjointly with the supports 3, define in each case one groove 6 which is enclosed in a U-shaped manner by the support 3 and the receptacle element 5.

Figure 3:
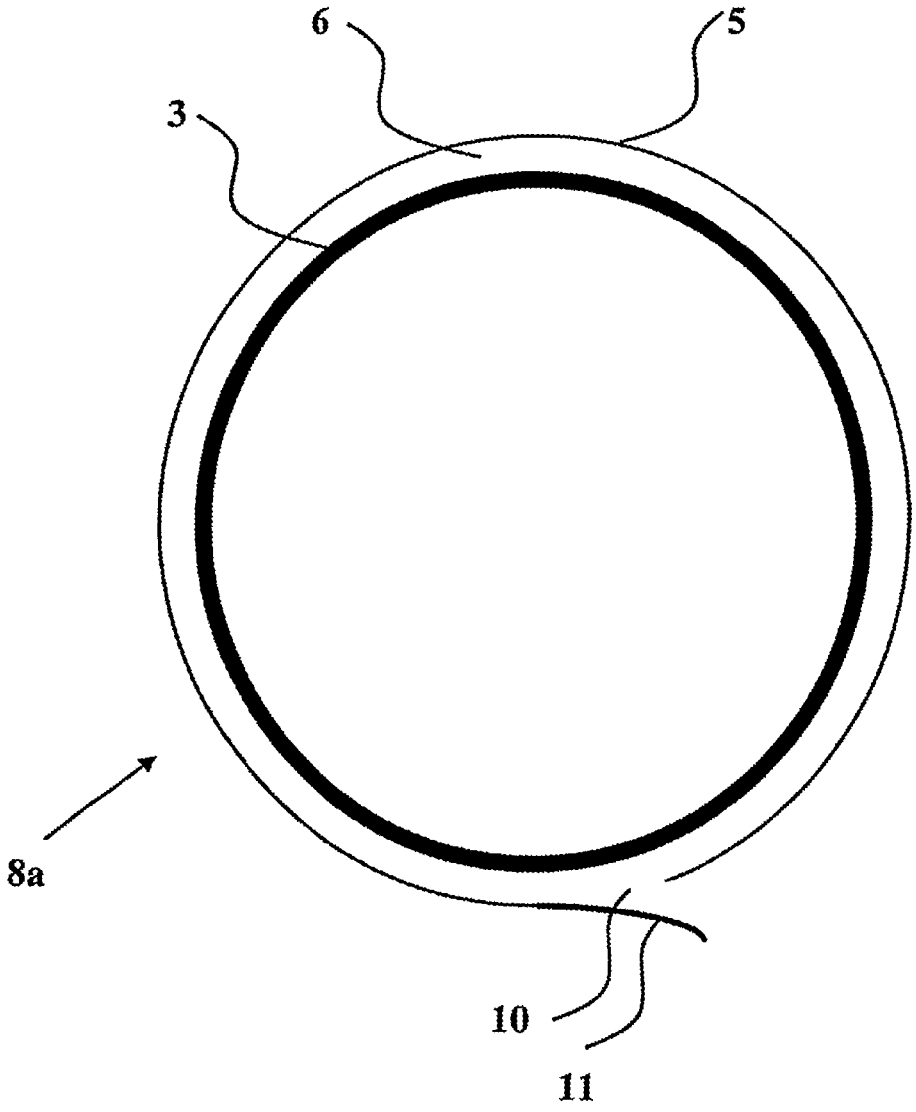
FIG. 3 shows a schematic view of the advertising system in a horizontal section.

The lower ring 8*a* of the receptacle 4 is illustrated in a plan view in FIG. 3.

The support 3 closed in a circular manner is enclosed by the ring 8*a* of the receptacle element 5, the ring 8*a* not being closed and being spaced apart. The intermediate space between the support 3 and the receptacle element 5 forms the groove 6 which is suitable for receiving and guiding in an annular manner a film 7 which is not illustrated in FIG. 3. The substructure of the groove 6 is not illustrated in FIG. 3 for reasons of clarity.

The receptacle element 5 does not form a closed ring. The gap of this ring 8*a* forms the introduction opening 10 for incorporating the film 7 (not illustrated here) into the groove 8, or for retrieving the film 7 (not illustrated here) from the groove 6.

The introduction is facilitated by the additional introduction region 11 because the introduction region 11, which directly adjoins the receptacle element 5, opens out radially as the spacing from the receptacle element 5 increases, and on account thereof forms an introduction opening 10 which widens in the manner of a wedge. The introduction opening 10 enables the film 7 to be incorporated in a very secure and reliable manner into the support 3 having the receptacle 4 of the advertising system 1. This is, particularly, important when the advertising system 1 according to the present invention is attached at a great height and when the film 7 is to be replaced for relaying other informative content, in particular, other advertising messages and/or logos and/or trademarks.

The illustrated advertising system 1 according to the present invention is distinguished by a particular informative effect and by particularly simple, reliable handling specifically with a view to the replacement of the film 7.

Various combinations as to how films 7 can be held on the supports 3 in that either guided elements 12 or receptacle elements 5 are in each case attached to the films 7 or to the supports 3, respectively, are in FIGS. 4.1 to 4.10. The combinations according to FIGS. 4.1 to 4.4 show exclusively variants in which the support 3 is provided with receptacle elements 5 on both sides, the film 7 being mounted between the receptacle elements 5. Only the variant in which the film 7 by way of both sides is in each case pushed into one groove 6 is illustrated in FIG. 4.1. According to FIG. 4.2, a guided element 12 in the form of a round-bodied profile is attached to the film 7 in the lower region, the element 12 being incorporated into and guided in a receptacle element 5 on the support 3 that corresponds in terms of shape. Corresponding embodiments having guided elements 12 in the lower region of the film 7 are illustrated in FIGS. 4.3 and 4.4, in one instance having a trapezoidal cross-section and in one instance having a flat cross-section.

FIGS. 4.5 to 4.7 differ from FIGS. 4.1 to 4.4 in that the receptacle elements or guided elements, respectively, in the lower region are laterally connected to the support 3. Guided elements 12 having in each case a round cross-section and a trapezoidal cross-section are disposed on the film 7 in FIGS. 4.5 and 4.6. In contrast, in FIG. 4.7 a guided element 12 is disposed on the bottom of the support 3, while the film 7 has a receptacle element 5 which in terms of the shaping corresponds to the guided element 12.

FIGS. 4.8 to 4.10 again have supports 3 which are provided with the receptacle element 5 on both sides. The films 7 are also correspondingly provided with guided elements 12 on both sites, the elements 12 in FIG. 4.8 having a round cross-section, in FIG. 4.9 having a trapezoidal cross-section, and in FIG. 4.10 having a flat cross-section.

Moreover, the following are conceivable as independent embodiments or embodiments combined with arbitrary features described in the application:

the film has a material thickness of a few tenths of a millimeter, in particular of approximately 0.2 mm and is formed, in particular, while using polycarbonate (PC), polyester, polyethylene (PE), polyvinylchloride (PVC), and/or polyether (PA); and/or the film is, in particular, configured so as to be structured in color; and/or the film in the peripheral region is configured so as to be at least partially reinforced; and/or the film in the peripheral region is configured so as to at least partially have a low coefficient of friction.

The films 7 in FIGS. 4.2 to 4.10 are in each case provided with guided elements 12 which are configured as a peripheral reinforcement or beading, for example. When taking into account that the film 7 is drawn into a ring, as is illustrated in FIG. 1 or 3, this will thus lead to increased friction, specifically when the guided element or the beading, respectively, has a certain flexural stiffness, because the guided element does not bend as intensely as the guide into which the guided element is to be drawn in, or in which the guided element is to run, respectively. The guided element or the beading, respectively, thus laterally presses against the guide, causes increased friction, and has the effect that the film can be drawn in only with difficulty. In one advantageous refinement of the present invention, the guided element or the beading, respectively, is therefore interrupted at least at one location, in particular a plurality of locations at, for example, equal intervals, such that more intense bending is possible at the locations of interruptions.

In general, differences in terms of length between the guided element or the beading, respectively, and the film can arise, specifically when the film is rolled up conjointly with the guided element/beading, because one of the components comes to lie on the inside during rolling-up and the radius is smaller. In this case there is the risk that the guided element or the beading, respectively, is released from the film. In order for this difference in terms of length to be compensated for, the guided element or the beading, respectively, in one advantageous refinement of the present invention can in turn be mounted so as to slide per se on the film.

Figure 5:
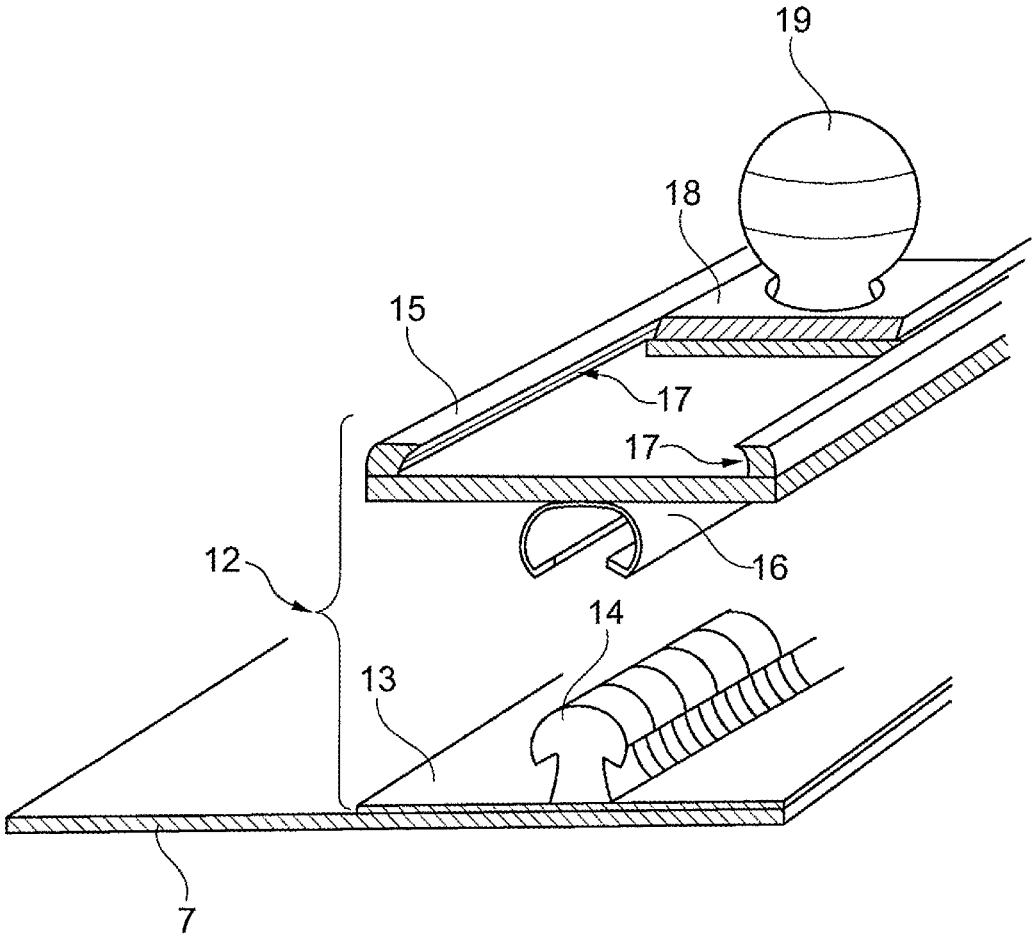
FIG. 5 shows a schematic illustration of a two-part beading.

A film 7 is illustrated in FIG. 5, a thin reinforcement film 13 being adhesively bonded directly to the periphery of the film 7. The reinforcement film 13 in turn is provided with a profile 14 which runs along the longitudinal extent of the film 7. The actual beading 15 has a rail 16 in which the profile 14 can be received in a retaining manner and mounted in a sliding manner. The profile 14 and the rail 16 can be simply snap-fitted or else pushed into one another. The beading 15 on the side opposite the rail 16 likewise has a guide profile 17 in which a slide 18 having a latching element 19 for further fastening to the support is displaceably mounted. The beading 15 can moreover also be interrupted at some locations such that the film 7 can be more easily drawn in without much force. The beading 15 is mounted in a sliding manner, can be displaced and thus compensate for deviations in terms of length also when the film 7 is being rolled up, or the beading 15 can also be pulled off the profile 14.

LIST OF REFERENCE SIGNS

1 Advertising system
2 Advertising space
3 Support
3*a* Support cable
4 Receptacle
5 Receptacle element
6 Groove
7 Film
8 Lower periphery, lower peripheral region
8*a* Lower ring
9 Upper periphery, upper peripheral region

9*a* Upper ring
10 Introduction opening
11 Introduction region
12 Guided element
13 Reinforcement film
14 Profile
15 Beading
16 Rail
17 Guide profile
18 Slide
19 Latching element

The invention claimed is:

1. An advertising system having an advertising space having a support, and having at least one annular film, wherein the support has at least one receptacle for receiving a planar film, wherein the film is configured so as to be able to be incorporated into the receptacle and replaced, and wherein the receptacle has a plurality of receptacle elements which individually or conjointly with the support form one or a plurality of grooves which are suitable and provided for receiving and guiding the film in an annular or partially annular manner in the formed groove, wherein an annular receptacle along the circumference has an introduction opening for incorporating the film into the annular receptacle, and wherein the introduction opening is provided with an introduction region which adjoins the annular receptacle so as to be approximately tangential thereto and which is suitable and provided for guiding the film such that the film can be incorporated into or retrieved from the annular receptacle, and wherein a peripheral region of the film is at least partially configured in a reinforced manner, and/or has at least one guided element to be received and/or guided in the groove and/or one of the grooves of the support, and wherein the at least one guided element comprises at least one profiled part which is connected to the film.

2. The advertising system as claimed claim 1, wherein the support has at least one guided element, and wherein the film comprises at least one film receptacle element for receiving and/or guiding the at least one guided element of the support.

3. The advertising system as claimed in claim 1, wherein the film has at least one film receptacle element which forms at least one groove, said at least one film receptacle element being suitable and provided for receiving and guiding in an annular or partially annular manner at least one of the at least one guided element of the support in the formed groove.

4. The advertising system as claimed in claim 3, wherein at least one of the at least one film receptacle element and/or the at least one guided element is disposed on the upper and/or the lower periphery of the support and is suitable and provided for guiding the upper and the lower periphery of the film.

5. The advertising system as claimed in claim 3, wherein at least one of the at least one film receptacle element and/or the at least one guided element is disposed so as to form at least one ring.

6. The advertising system as claimed in claim 3, wherein at least one of (1) a plurality of the at least one film receptacle element, (2) a plurality of the at least one guided element, and (3) at least one of the at least one film receptacle element and at least one of the at least one guided element, are disposed to be mutually spaced apart and conjointly form at least one ring.

7. The advertising system as claimed in claim 3, wherein the at least one film receptacle element and/or at least one of the at least one guided element form two rings and are disposed to be mutually offset along the circumference of the support.

8. The advertising system as claimed in claim 3, wherein the support and the receptacle and/or the at least one film receptacle element are integrally configured to form a supporting structure.

9. The advertising system as claimed in claim 3, wherein at least one of the at least one guided element and a corresponding one of the at least one film receptacle element for receiving and guiding the guided element are configured to have mutually corresponding shapes in cross-section.

10. The advertising system as claimed in claim 1, wherein the introduction opening and/or the introduction region are/is configured for sliding the film into the receptacle and retrieving said film therefrom on both sides thereof.

11. The advertising system as claimed in claim 1, wherein the planar film has an OLED and/or QLED display device so as to implement a variable advertising space.

12. The advertising system as claimed in claim 11, wherein the OLED and/or QLED display device implements a projection of a movie or temporary static display.

* * * * *